US006438844B2

(12) United States Patent
Nolden

(10) Patent No.: US 6,438,844 B2
(45) Date of Patent: Aug. 27, 2002

(54) METHOD AND APPARATUS FOR MANUFACTURING CONSTANT VELOCITY JOINTS

(75) Inventor: Reiner Nolden, Kerpen (DE)

(73) Assignee: Ford Global Tech., Inc., Dearborn, MI (US)

( * ) Notice: Subject to any disclaimer, the term of this patent is extended or adjusted under 35 U.S.C. 154(b) by 0 days.

(21) Appl. No.: 09/817,918

(22) Filed: Mar. 26, 2001

Related U.S. Application Data

(63) Continuation of application No. 09/269,008, filed as application No. PCT/EP97/04769 on Sep. 2, 1997, now abandoned.

(30) Foreign Application Priority Data

Sep. 17, 1996 (DE) ..... 19637839

(51) Int. Cl.[7] ..... B21K 1/04

(52) U.S. Cl. ..... 29/898.066; 72/67; 72/115; 72/344; 72/359

(58) Field of Search ..... 29/898.066; 72/67, 72/115, 353.4, 353.6, 354.2, 344, 345, 352, 356, 358, 359, 398

(56) References Cited

U.S. PATENT DOCUMENTS 4,698,992 A * 10/1987 Bernet ..... 72/67
5,001,920 A * 3/1991 Ishinaga et al. ..... 72/345
5,186,082 A * 2/1993 Kuramitsu et al. ..... 76/107.1
5,697,245 A * 12/1997 Maeng ..... 72/353.4
5,765,430 A * 6/1998 Iihara et al. ..... 72/353.4
5,768,934 A * 6/1998 Urban et al. ..... 72/370.05
5,829,911 A * 11/1998 Yokota et al. ..... 403/359
5,865,055 A * 2/1999 Morozumi ..... 72/224
6,035,688 A * 3/2000 Nagao et al. ..... 72/342.3
6,044,684 A * 4/2000 Ohama et al. ..... 72/354.2
6,053,023 A * 4/2000 Landrum ..... 72/355.4
6,055,838 A * 5/2000 Ohama et al. ..... 72/356
6,146,281 A * 11/2000 Iijima et al. ..... 464/139
6,189,362 B1 * 2/2001 Nagao et al. ..... 72/344
6,224,490 B1 * 5/2001 Iihara et al. ..... 464/145
6,389,868 B2 * 5/2002 Nagao et al. ..... 72/359

* cited by examiner

*Primary Examiner*—S. Thomas Hughes
*Assistant Examiner*—Essama Omgba
(74) *Attorney, Agent, or Firm*—Ford Global Tech., Inc.

(57) ABSTRACT

A method and tool are provided for manufacturing an outer race for constant velocity joints by plastic deformation of a preform having a cavity open on one side to produce axial ball tracks and cage guide surfaces. the preform is inserted within an outer tool. An inner tool is inserted within the preform. The preform is wobble pressed with the inner tool.

9 Claims, 1 Drawing Sheet

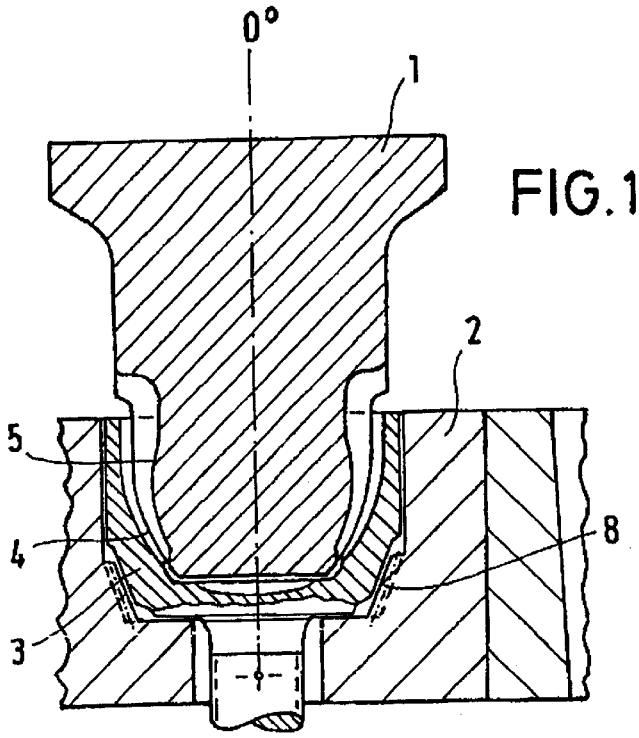
FIG.1
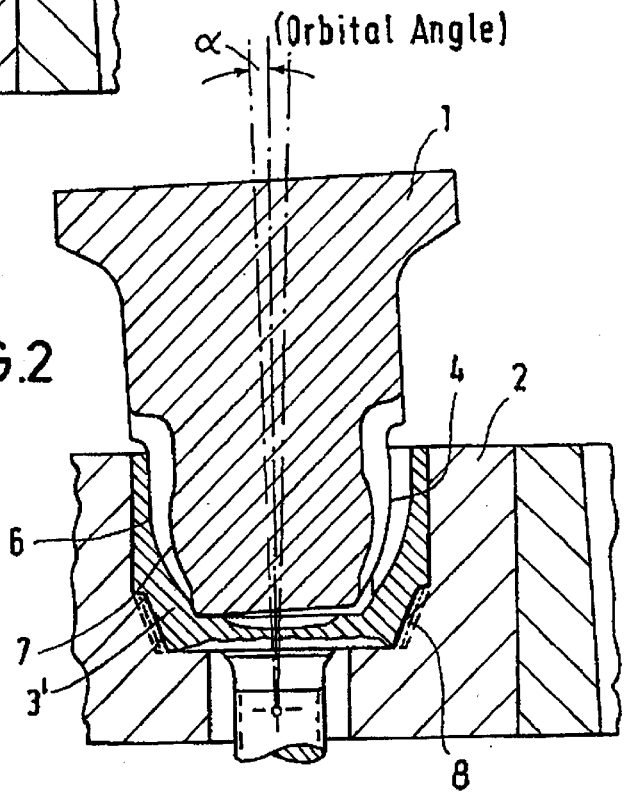
FIG.2
FIG.3
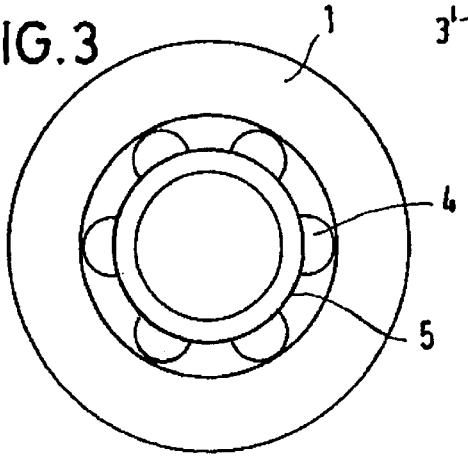

METHOD AND APPARATUS FOR MANUFACTURING CONSTANT VELOCITY JOINTS

"This application is a continuation of copending applications application Ser. No. 09/269,008 filed on Mar. 17, 1999 now abandoned which is a 371 of International Application PCT/EP97/04769 filed on Sep. 2, 1997, and which designated the U.S."

FIELD OF THE INVENTION

The invention relates to a method for manufacturing constant velocity joints, and more particularly to the manufacture of an outer race for a constant velocity joint.

BACKGROUND INFORMATION

German Offenlegungsschrift 37 12 301 (German '301) discloses a press tool for plastic deformation of a preform having a cavity open on one side to produce non-undercut axial ball tracks and cage guide surfaces. The preform is received in a female tool and the shaping of the wall regions is then performed by a male, or inner, tool with the application of pressure.

In German '301, the male tool consists of an inner die having individual radial ribs which reach through segments of a sleeve die to provide a forming surface which is closed in the circumferential direction. The joint between the two arts of the male tool is always in the transition between the all track forming region and the cage guide surface forming region.

The part of the male tool for making the ball tracks is formed by a one-piece solid tool part which can accept large forces without distortion or change in shape. This makes it possible to shape the ball track portions so precisely that no finishing operation is needed in these regions.

The intervening undercut cage guide surface regions are formed by the outwardly crowned segments of the sleeve die of the male tool, the segments of which, after removal of the inner die, can be removed from the finished workpiece by springing them radially inwardly.

The known press tool has the disadvantage that the two-piece inner tool is extremely complex and costly to manufacture and, owing to the parting surfaces formed between the two parts of the tool, namely, the inner die and the sleeve die, has increased susceptibility to wear.

A further disadvantage is that the tolerances required for making the forming tool in two parts necessarily lead to an increase in the workpiece tolerances, that is to say, the current tool tolerances must be added to the specified workpiece tolerances.

German Offenlegungsschrift 42 14 444 (German '444) discloses a method for the manufacture of ball sockets for constant velocity joints wherein a cup-shaped blank is progressively locally plastically deformed radially as a function of time, with plastic reduction in section, to shape its inner form against a profiled mandrel which in the circumferential direction is corrugated and which in the axial direction has different convex curvatures which vary, preferably segmentally, around the circumference. The profiled mandrel used here is multipart and consists of radially separable profiled mandrel segments.

The German '444 method also has the disadvantage that the profiled mandrel used, because of its multipart design, is complex and expensive to manufacture and is susceptible to wear. A further disadvantage is that the tolerances required for the division of the forming tool in two necessarily lead to increase in the workpiece tolerances, i.e., the current tool tolerances must be added to the specified workpiece tolerances.

The object of the invention is to provide a method for the manufacture of outer parts of constant velocity joints of the kind referred to in which the disadvantages of the known manufacturing process which have been pointed out are avoided and in which ball tracks can be made either without or with undercuts.

To this end, in accordance with the invention, a method and tool are provided for manufacturing an outer race for a constant velocity joint by plastic deformation of a preform having a cavity open on one side to produce axial ball tracks and cage guide surfaces. The preform is inserted within an outer tool. An inner tool is inserted within the preform. The insert is wobble pressed with the inner tool.

As a result of using as the inner tool a one-piece pressing die having segments with different convex curvatures and having a particular external contour, which is introduced into the cavity and which, by wobble pressing, produces the desired final form of the inner wall regions for the ball track and the cage guide surfaces in a plurality of locally progressive revolution, a very robust forming tool is provided which leads to improved workpiece tolerances.

BRIEF DESCRIPTION OF THE DRAWINGS

The invention will be described in more detail with reference to the accompanying drawings, in which:

FIG. 1 shows a vertical section through the tool-preform arrangement at the start of the forming;

FIG. 2 shows a vertical section through the tool-workpiece arrangement after the wobble forming; and FIG. 3 is a bottom view of the one-piece inner tool.

DETAILED DESCRIPTION OF PREFERRED EMBODIMENTS

A male inner tool 1 is in the form of a one-piece wobble pressing die. The inner tool 1 has an outer contour which has, by segments, different convex curvatures and includes rib-shaped contours 4 for the ball tracks and adjacent contours 5 for the cage guide surfaces. The corresponding outer contours 4 and 5 are designed on the basis of a particular orbital angle $\alpha$ in order to produce the desired final guide surfaces.

The preform 3 is received and fixed in a female, or outer, tool 2. At the start of the working, the outer tool 2 is moved upwards to the shaping die 1, which is preferably fixed axially and disposed centrally with respect to the machine axis. The shaping die of the inner tool 1 is now set in wobbling movement. An intermittent shaping force moves corresponding to the course of the movement—depending on the wobble frequency and the orbital angle $\alpha$—circularly over the surfaces of the preform 3 which are being shaped. Thus, only a fairly small region of the ball tracks 6 and cage guide surfaces 7 is being worked in any unit of time. The shaping die is rolled on the preform 3, i.e., between material and shaping tool 1 there is rolling sliding friction. The rolling friction is considerably less than the friction normally encountered in the conventional shaping process. The yield stress of the material is only slightly exceeded by the maximum stress occurring, thereby ensuring a better flow of material.

As soon as the desired final contours of the ball tracks 6 and the cage guides 7 have been reached, the inner tool 1 is again disengaged to a position central of the axis of the machine, and the workpiece 3' can be ejected from the outer tool 2 by an ejector.

As a result of the stepwise displacement of material produced by the wobble pressing, very precise shaping and very high surface quality can be relied on, so that subsequent machining of the ball tracks and the cage guide surfaces is no longer necessary.

Simultaneously with the production of the inner contour of the outer joint part, external splines 8 can be formed on the outer contour of the preform 3. The outer splines 8 hold the preform 3 precisely in position and prevent it from twisting in the outer tool 2 under the influence of the wandering torque of the wobbling movement.

With suitable design, the external splines can be used as speed sensor for an ABS system.

The forms of the invention shown and described herein constitute preferred embodiments of the invention. They are not intended to illustrate all possible forms thereof. The words used are words of description rather than of limitation, and various changes may be made from that which is described herein without departing from the spirit and scope of the invention.

What is claimed is:

1. A method for manufacturing an outer race for a constant velocity joint by plastic deformation of a preform having a cavity open on one side to produce axial ball tracks and cage guide surfaces, the method comprising:

providing an outer tool having an inner contour;

inserting the preform within the outer tool;

inserting an inner tool within the preform, said inner tool comprising a one-piece wobble pressing die having first and second segments of different convex curvature, the first segments being rib-shaped and for forming the ball tracks and the second segments being adjacent to the first segments and for forming the cage guide surfaces;

wobble pressing the preform with the inner tool;

axially plunging the inner tool while the inner tool wobble presses the preform;

simultaneously forming external splines on an outer contour of the preform by said axial plunging of the inner tool while the inner tool wobble presses the preform with the inner tool; and precisely holding the preform in a certain position within the outer tool while wobble pressing the preform, wherein the formed external splines and the inner contour of the outer tool cooperate to precisely hold the preform and prevent the preform from twisting within the outer tool.

2. The method according to claim 1, further comprising forming undercut-free ball tracks in the preform.

3. The method according to claim 1, further comprising forming ball tracks having an undercut in the preform.

4. A tool for manufacturing an outer race for a constant velocity joint by plastic deformation of a preform having a cavity open on one side to produce axial ball tracks and cage guide surfaces, the tool comprising:

an outer tool for holding the preform, the outer tool having a contour for forming external splines on the preform, wherein the contour prevents the preform from rotating within the outer tool;

an inner tool for wobble pressing the preform with the outer tool, the inner tool comprising a one-piece wobble pressing die having first and second segments of different convex curvature, the first segments being rib-shaped and for forming the ball tracks and the second segments being adjacent to the first segments and for forming the cage guide surfaces; and means for axially plunging one of the inner tool or preform while the inner tool wobble presses the preform.

5. The tool according to claim 4, further comprising the first segment having a contour for forming undercut-free ball tracks in the preform.

6. The tool according to claim 4, further comprising the first segment having a contour for forming ball tracks having an undercut in the preform.

7. A method for manufacturing an outer race for a constant velocity joint from a preform having a cavity open on one side to produce axial ball tracks and cage guide surfaces, the method comprising:

inserting the preform within an outer tool having an inner contour;

forming an inner tool from a one-piece wobble pressing die having first and second segments of different convex curvature, the first segments being rib-shaped and for forming the ball tracks and the second segments being adjacent to the first segments and for forming the cage guide surfaces;

inserting the inner tool within the cavity of the preform;

plastically deforming the preform by wobble pressing the preform with the inner tool while axially plunging one of the preform or inner tool;

simultaneously forming external splines upon an outer contour of the preform by said axially plunging one of the preform or inner tool into the contour of the outer tool; and precisely holding the preform within the outer tool to prevent the preform from twisting within the outer tool by utilizing the intermeshing formed external splines and the contour of the outer tool.

8. The method according to claim 7 further comprising forming undercut-free ball tracks in the preform.

9. The method according to claim 7 further comprising forming ball tracks having an undercut in the preform.

* * * * *